US010697451B2

(12) United States Patent
Cote

(10) Patent No.: US 10,697,451 B2
(45) Date of Patent: Jun. 30, 2020

(54) APPARATUS AND METHOD FOR PUMPING A RESERVOIR

(71) Applicant: LEIGH TECHNOLOGIES INC., Cochrane (CA)

(72) Inventor: Brennon Leigh Cote, Cochrane (CA)

(73) Assignee: LEIGH TECHNOLOGIES INC., Cochrane, AB (CA)

( * ) Notice: Subject to any disclaimer, the term of this patent is extended or adjusted under 35 U.S.C. 154(b) by 142 days.

(21) Appl. No.: 15/458,284

(22) Filed: Mar. 14, 2017

(65) Prior Publication Data

US 2018/0266221 A1 Sep. 20, 2018

(51) Int. Cl.

| | |
|---|---|
| ***F04B 53/20*** | (2006.01) |
| ***F04B 47/10*** | (2006.01) |
| ***E21B 43/12*** | (2006.01) |
| ***F04B 47/00*** | (2006.01) |

(52) U.S. Cl.

CPC ..... *F04B 53/20* (2013.01); *E21B 43/126* (2013.01); *F04B 47/00* (2013.01)

(58) Field of Classification Search

CPC ..... E21B 43/121; E21B 43/128; F04B 53/20; F04B 47/00; F04B 47/10

See application file for complete search history.

(56) References Cited

U.S. PATENT DOCUMENTS

| | | | | |
|---|---|---|---|---|
| 5,611,397 | A * | 3/1997 | Wood | E21B 43/129 166/105 |
| 6,907,925 | B2 | 6/2005 | Cote | |
| 7,290,608 | B2 | 11/2007 | Wittrisch | |
| 7,975,765 | B2 * | 7/2011 | Manson | E21B 37/00 166/105 |
| 2010/0038142 | A1 * | 2/2010 | Snyder | E21B 4/02 175/107 |
| 2015/0064037 | A1 | 3/2015 | Kourakos et al. | |
| 2015/0226046 | A1 * | 8/2015 | Wolf | E21B 43/126 166/372 |

FOREIGN PATENT DOCUMENTS

| | | | |
|---|---|---|---|
| CA | 2471681 | A1 | 12/2005 |
| CA | 2510240 | A1 | 12/2005 |

* cited by examiner

*Primary Examiner* — Michael R Wills, III
(74) *Attorney, Agent, or Firm* — Field LLP

(57) ABSTRACT

A device is taught for pumping fluid from a downhole reservoir up to surface. The device comprises a conduit extending through at least a portion an axial bore of the rotor unit and in communication with one or more recirculation inlets for receiving a recirculation stream of fluid and directing under pressure through the conduit, wherein an inside diameter and length of the conduit define a flow restriction; and one or more recirculation outlets defined in a stator unit downstream of the pump fluid intake, for delivering the recirculation stream of the fluid under pressure from the conduit and directing it at the pump fluid intake. A method is also taught for washing particulate from an intake end of a pump.

18 Claims, 4 Drawing Sheets

APPARATUS AND METHOD FOR PUMPING A RESERVOIR

FIELD OF THE INVENTION

The present invention provides an apparatus and method of preventing debris in a progressive cavity pumping application.

BACKGROUND

The subject of the present disclosure relates generally to downhole wellbore systems used for pumping hydrocarbon products to surface. Such systems are often called artificial lift systems. The present systems typically use a progressive cavity (PC) pump to pump liquid hydrocarbon from underground formations in a cased wellbore up to surface. The stator portion of the PC pump is typically run down on a tubing string and the rotor portion of the PC pump is run into the stator on a rod string. Movement of the rotor within the stator creates a series of annular spaces through which fluid travels as the PC pump operates. Fluid is pumped from a lower inlet between the rotor and stator up through the annular spaces to surface.

In wells with high solids contend, the issue of build-up of solids blocking the inlet of the annular space, thereby preventing the pump from pumping.

To overcome this issue, and to wash out debris accumulating at the pump inlet end, hollow rotors have been used in the past, see for example U.S. Pat. No. 6,907,925 to Cote. This patent proposes a portion of the rotor being hollow with a central bore extending from a primary orifice near the pump primary inlet to a secondary orifice spaced away from the primary pump inlet. A means is provided for diverting a portion of the fluids being pumped into the secondary orifice and diverting down through the bore and out the primary orifice to thereby wash away accumulated solids from the primary pump inlet. However, to ensure that fluid enters at the secondary orifice and exits at the primary orifice, against the pressure of fluid in the pump, sufficient pressure drop or fluid resistance is required in the bore. In order to achieve sufficient pressure drop, the primary orifice is sized and or otherwise designed to restrict the primary orifice to thereby create the backpressure required to overcome the pressure of the PC pump itself and exit the primary orifice with sufficient pressure to wash away the debris. Such precise sizing of the primary orifice is rendered useless when fluid dynamics of the fluid being pump changes and the restriction becomes too small or too large to provide proper back pressure. Furthermore, the restrictive sizing of the orifice commonly leads to blockage of the orifice when larger particulate travels down the central bore. To avoid blockage of the bore itself with debris from the fluid being pumped, a screen or filter is required to be applied over the secondary orifice, and such screen leads to further potential blockages. Furthermore, it has been found that such a screen or filter itself cannot restrict all particulates.

Other devices, such as that taught in CA 2,510,240 teach an external circulation conduit with a venture style circulation nozzle for taking a side stream of fluid and re-direct it at the pump intake. However, external conduits have a tendency to become damaged during installation, or vibrate and shake as described on page 10, creating fatigue in the device, and need to be strapped or otherwise secured to pump to avoid it breaking off. Furthermore, while the circulation nozzle can be changed to change the restriction of the nozzle orifice, this still does not adapt to changes in fluid dynamics during a pumping operation. Pumping would need to be stopped and that pump string brought to surface for the nozzle to be changed each time fluid dynamics changed.

Further prior art systems, such as that shown in U.S. Pat. No. 7,290,608 to Wittrisch, teach a separate tube or line connected to a secondary fluid source and a pump, said separate line running through the rotor to pump a secondary fluid to the PC pump inlet. Such designs necessitate a completely separate system of secondary fluid storage, pumping and piping through the existing PC pump system. The secondary pump must be large enough to overcome the PC pump pumping pressure to ensure that the secondary fluid will in fact flow through the piping and exits the rotor under sufficient pressure to wash away debris. The system further adds additional surface equipment, piping and increased expense to the system.

A need therefore exists in the art for a device and method for keeping PC pump intakes free from debris and keeping agitation at the pump inlet steady to encourage circulation.

SUMMARY

The present invention provides a device for pumping fluid from a downhole reservoir up to surface. The device comprises a stator unit run down the wellbore; a rotor unit run down the wellbore within the stator unit, said rotor being hollow and defining a bore therein, the rotor unit and the stator unit engaging with one another to form an annular space therebetween for carriage of fluid; a pump fluid intake formed in a downstream end of the stator unit for entry of fluids from the wellbore into the annular space; one or more recirculation inlets defined in the rotor unit upstream of the pump fluid intake for receiving a recirculation stream of the fluid; a conduit extending through the bore in the rotor unit from a first end proximal said one or more recirculation inlets to a second end proximal the pump fluid intake, for receiving the recirculation stream of fluid and directing the fluid under pressure through the conduit, wherein a length of the conduit defines a flow restriction; and one or more recirculation outlets defined in the stator unit downstream of the pump fluid intake, for delivering the recirculation stream of the fluid under pressure from the conduit and directing it at the pump fluid intake.

The present invention further presents a method of washing particulate from an intake end of a pump. The method comprises the steps of directing a recirculating stream of fluid to be pumped into a conduit extending through an axial bore in a rotor unit of the pump; directing the recirculation stream of fluid and under pressure through the conduit, from a first end proximal said one or more recirculation inlets to a second end proximal the pump fluid intake, wherein a length of the conduit defines a flow restriction; and delivering the recirculation stream of the fluid under pressure from the conduit and directing it at the pump fluid intake to thereby wash away particulate from the pump fluid intake.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings.

Figure 1:
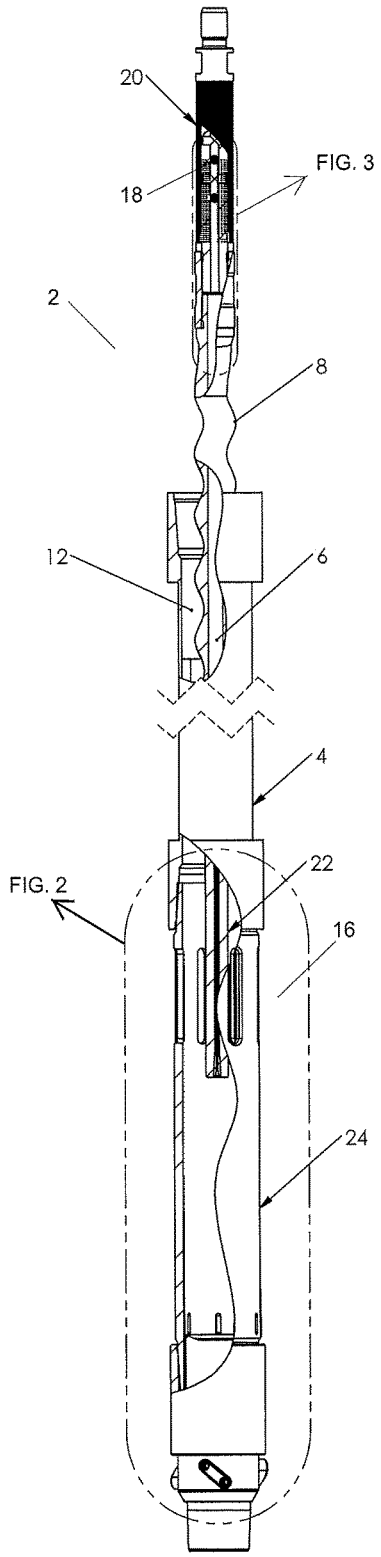
FIG. 1 is a partial cross sectional elevation view of one example of a PC pump system of the present invention, illustrating a tubing string carrying the stator, a rod string carrying the rotor and associate further elements.

The drawing is not necessarily to scale and in some instances proportions may have been exaggerated in order more clearly to depict certain features.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The present disclosure relates to a device and methods for reducing debris accumulation on the intake end of PC pumps. Furthermore the present devices and methods for encouraging agitation and circulation at a PC pump intake, to further reduce debris build up and blockage at the PC pump intake. More specifically, the present disclosure provides a PC pump hollow rotor with no orifice restriction at the PC pump intake end.

With reference to the figures, FIG. 1 shows a PC pump 2, comprising a stator 4 run on a tubing string and a rotor 8 run through the tubing string and into the stator 4 on a rod string. Between an outer surface of the rotor 8 and an inner surface of the stator 4 is defined an annular space 12 through which wellbore fluid is produced to surface.

Figure 2:
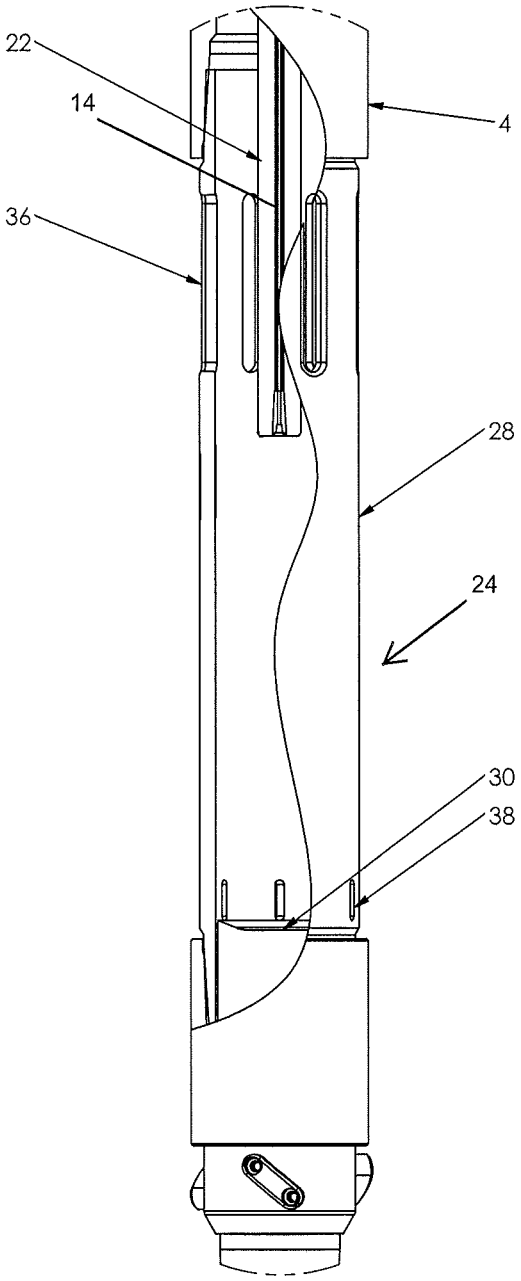
FIG. 2 is a detailed partial cross sectional elevation view of the intake end of one the PC pump of FIG. 1, showing the vortex sub with perforations in sidewall.
Figure 3:
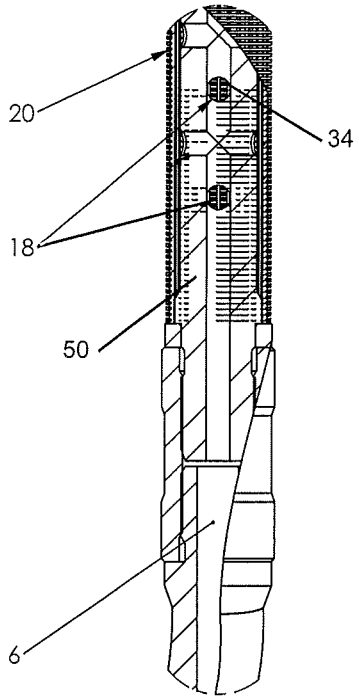
FIG. 3 is a detailed partial cross sectional elevation view of a recirculation inlet end of the hollow rotor of the present invention.
Figure 4:
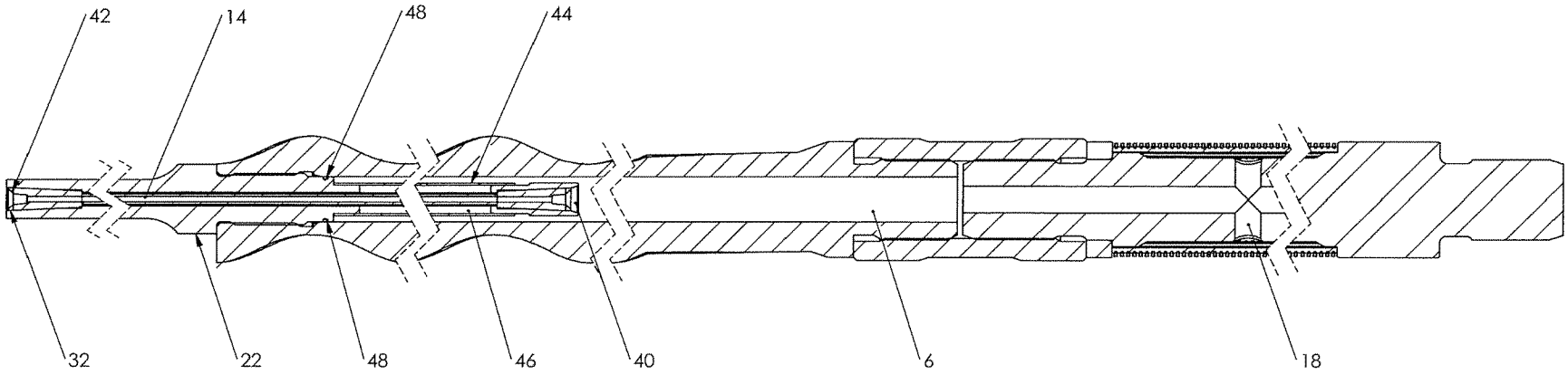
FIG. 4 is a cross sectional detailed view of an example of the hollow rotor of the present invention, showing the conduit running therethrough and the blade.

The present rotor 8 comprises a hollow bore 6 that runs through the length of the rotor 8. Within the hollow bore 6 is run a conduit 14 that extends approximately the length of the rotor 8. In some embodiments, the conduit 14 may extend beyond the length of the rotor 8, as discussed below. A recirculation stream of fluid being produced by the PC pump 2 is recirculated into the hollow bore 6 through one or more recirculation inlets 18 located near an upstream end of the rotor 8, as seen in FIGS. 3 and 4, then travels down through the conduit 14 and exits at a downstream end of the rotor 8, proximal a PC pump intake end 16, as seen in FIGS. 2 and 4.

The length of the conduit 14 can vary depending on the fluid to be produced, the pumping capacity required and the pressure seen at an intake end 16 of the PC pump 2. The length of the conduit 14, is preferably sized to provide a flow restriction across the length of the conduit 14 to build up a back pressure in the recirculation fluid to ensure that the fluid exits the conduit with sufficient force to create a backwash at the PC pump intake end 16. The inside diameter of the conduit 14 is adjustable depending on the viscosity and nature of the fluid to produced and size of particulate within the fluid. Preferably, the inside diameter of the conduit 14 is large enough to all passage of particular without blocking the conduit 14.

In the present disclosure, the length of the conduit 14 itself acts as a flow restriction to ensure sufficient back pressure to create stream of high shear fluid to wash away debris as the fluid leaves the conduit proximal the PC pump intake end 16. There is no need for an outlet orifice with restricted size to create the desired back pressure, both the inlet and the outlet of the conduit 14 are the same size and present no flow restriction.

Back pressure to create high shear fluid stream to wash debris away from the PC pump intake end 16 is accomplished by using the conduit 14. The back pressure created by the conduit 14 relates directly to the pressure needed to produce fluid to surface. In the present invention, recirculation of fluid though the conduit 14 is preferably about 30-50% of the total volume of fluid being pumped, to create the desired backwash pressure and flow.

The conduit 14 allows for the rotor 8 to incorporate a larger hollow bore 6, having a larger inside diameter (ID) than prior art hollow rotors. This is because any flow restriction needed to create sufficient back pressure is created by the conduit 14, and not merely by a hollow bore in the rotor. As such, the hollow bore 6 can be dimensioned in any standard inside diameter and the conduit 14 can be more specifically manufactured with a desired ID and length to create back pressure and flow shear. By way of example only, in one embodiment, the conduit may have an ID of from 0.08" to 0.4", and more preferably can be between 0.09" and 0.1". As mentioned above, the conduit 14 ID is also sized to enable any debris from the produced fluid entering the conduit 14 to pass through the conduit 14 and not plug it. The conduit 14 maintains a constant channel size throughout, with not separate flow restriction required at either the inlet or the outlet of the conduit 14.

With reference to FIG. 3, preferably, a screen 20 is provided at the recirculation inlet 18 which further provides a restriction from debris entering the system. More preferably, apertures of the screen 20 are of a size smaller than the channel inside diameter of the conduit 14 to ensure that debris that passes through the screen 20 is always smaller than the ID of the conduit 14 ensure the conduit 14 does not plug off.

Recirculation inlets 18 are preferably drilled into a rotor coupling 50 at an upstream end of the rotor 8, the rotor coupling 50 consisting of the screen 20. More preferably, the recirculation inlet 18 is comprised of several redundant inlets to allow fluid passage without restriction. The recirculation inlets 18 are preferably sized such that their total cross sectional area is equivalent to approximately double the flow area of the conduit 14, to reduce fluid velocities entering through the screen 20. A lower velocity of fluid at entry prevents and reduces instances of the screen 20 becoming plugged, as could happen if the fluid is forced through the recirculation inlets 18 and screen 20 at high velocity.

Referring now to FIGS. 1 and 2, the PC pump intake end 16 is modified by the inclusion of a vortex sub 24 extending into the sump (not shown) of the reservoir. The vortex sub 24 is preferably a separate sub on the tubing string connected to a lower end of the stator 4. The vortex sub 24 comprises a pervious sidewall 28 and an impervious base 30. The pervious sidewall 28 preferably comprises one or more PC pump inlet perforations 36 through which fluid to be produces enters the annular space 12 between the stator 4 and the rotor 8, to be pumped to surface. The pervious sidewall 28 further comprises one or more recirculation outlet perforations 38 formed in the perforated sidewall. More preferably the recirculation outlet perforations 38 are angled such that recirculation fluid exiting the perforations 38 flows a vortex pattern up and around to the PC pump intake 16 areal thereby forming a swirl or vortex of flow that prevents debris build up at the PC pump inlet perforations 36 at the PC pump intake end 16. In a further preferred embodiment, the impervious base 30 is curved concavely upwards in the form of a shallow bowl, said shape further directing recirculation fluid to flow upwardly and outwardly out of recirculation outlet perforations 38. More preferably, the recirculation outlet perforations are sized based on fluid type and severity of particulates being presented in the wellbore.

With reference to FIGS. 2 and 4, the present hollow rotor 8 is further fitted with a blade 22 at the PC pump intake end 16 and the conduit 14 extends through the rotor 8, through the blade 22 to a conduit outlet 32 at an end of the blade 22. The conduit 14 throughout preferably has the same inside diameter, presenting no orifice restriction.

The blade 22, is more preferably paddle-shaped, having two opposing flatter faces and two opposing narrower sides. As the rotor 8 rotates, the blade 22 also rotates, thereby serving to agitate the production fluid further within the vortex sub 24 at the PC pump intake end 16.

The conduit outlet end 32 at the end of the blade 22 is preferably located downstream of the PC pump inlet perforations 36. This location helps to ensure that recirculating fluid exiting the conduit 14 does not merely get sucked up into the annular space 12 together with fluid being pumped through the PC Pump intake 16 and up to surface. The conduit outlet 32 at the end of the blade 22 should also preferably be located upstream of the impervious base 30 of the vortex sub 24, to ensure that there is no impedance of rotation of the blade 22, that rotates with the rotor 8.

With reference to FIG. 4, a number of optional features may be present in relation to the conduit 14. Firstly, the inlet to the conduit 14 may be spaced adjacent to or downstream of the one or more recirculation inlets 18. In the case in which the conduit 14 inlet is downstream of the recirculation inlets 18, the conduit 14 may comprise a directing means 40 to direct fluid that enters the hollow bore 6 from the recirculation inlets 18 into the conduit 14. The directing means 40 helps to direct fluid into the conduit and also reduces abrasion of the conduit inlet. The directing means 40 can be a funnel or an angled mouth or opening of the conduit, or vanes or any other directing means that would be well understood by a person of skill in the art. Similarly, at the outlet end 32 of the conduit 14, at the end of the blade 22, a second directing means 42 to ease and direct exit of fluids from the conduit 14.

In some embodiments, the conduit 14 may be supported within a section of tubing 44. The optional tubing 44 is more preferably sized to have an outside diameter that fits easily into the hollow bore 6 while minimizing radial or lateral movement or wiggling within the bore 6. In some embodiments, the conduit 14 may be held and radially centralized within the tubing 44 by any number of centralizers 46 known in the art, such as centralizer blocks, rings, fillers etc. Preferably the centralizer 46 takes the form of a filler material placed between the tubing 44 and the conduit 14 to keep the conduit radially centralized within the tubing 44 and to reduce movement of the conduit 14 within the tubing 44. More preferably, the centralizer 46 is an epoxy filler material injected between the conduit 14 and the tubing 44.

As seen in FIG. 4, the blade 22 extends from a lower end of the rotor 8. More preferably, the blade 22 includes an engaging end that can be inserted and connected into the hollow bore 6 at the downstream end of the rotor 8. More preferably, the blade 22 can be threaded, friction fit, welded or otherwise secured into the hollow bore 6. Further still preferably, a sealing member 48 such as an o-ring or other sealing means may be present between an outer surface of the engaging end of the blade 22 and an inner surface of the hollow bore 6 to ensure that no fluid from outside of the rotor enters the hollow bore 6.

In a preferred embodiment, an insert 34 such as for example a ceramic insert, is provided on each recirculation inlet 18 to reduce abrasion of the recirculation inlets 18 by debris.

In operation, as the PC pump 2 is operated, the rotor 8 is driven by a drive means (not shown) to rotate within the stator 4, thereby drawing fluid from a fluid reservoir in through the PC pump inlet perforations 36 and into annular space 12, where rotation of the rotor 8 serves to draw the fluid up to surface through the annular space. As fluid flows upstream, a recirculation side stream of the fluid enters recirculation inlets 18 and is directed into the conduit 14. The recirculation stream of fluid travels down the conduit 14 and exits the conduit 14 at the end of the blade 22 and then exit the vortex sub 24 through recirculation outlet perforations 38. The length of the conduit 14 creates a flow restriction that ensures that the recirculation side stream exits the outlet perforations 38 at a speed and force to cause a vortex of fluid circulation in the vortex sub and around the PC Pump inlet perforations 18. The vortex flow of recirculation fluid around the PC Pump intake end 16 and in the vortex sub keeps any particulate suspended in the fluid being pumped and reduces particulate and debris build up in the vortex sub 24 and around the PC pump inlet perforations 36.

In a further preferred embodiment, recirculation of fluid though the conduit 14 serves to cool the rotor 8, in addition to providing backwash and debris reduction. When recirculation fluid is diverted into recirculation inlets 18 and in through the conduit, the fluid flow acts as a heat exchanger to cool the rotor 8 from the inside. Rotors 8 are often made of dense, heat retaining materials, and due to their constant torqueing, build up heat. Since rotors 8 are surrounded by the stator 4, there is no space around the rotor 8 to dissipate heat. Thus, recirculation of fluid through the conduit 14 serves to transfer heat out of the rotor material and send it out through the fluid being produced at surface.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A device for pumping fluid from a downhole reservoir up to surface, said device comprising;

a. a stator unit run down the wellbore;

b. a rotor unit run down the wellbore within the stator unit, said rotor unit being hollow and defining a bore therein, the rotor unit and the stator unit engaging with one another to form an annular space therebetween for carriage of fluid;

c. a pump fluid intake formed in a downstream end of the stator unit for entry of fluids from the wellbore into the annular space;

d. one or more recirculation inlets defined in the rotor unit upstream of the pump fluid intake for receiving a recirculation stream of the fluid;

e. a conduit extending through the bore in the rotor unit from a first end proximal said one or more recirculation inlets to a second end proximal the pump fluid intake, for receiving the recirculation stream of fluid and directing the fluid under pressure through the conduit, wherein a length of the conduit provides a flow restriction; and for delivering the recirculation stream of the fluid under pressure and directing it at the pump fluid intake with sufficient force to create a backwash at the pump fluid intake.

2. The device of claim 1, wherein the stator unit comprises:

a) a stator; and b) a vortex sub connected to a downstream end of the stator.

3. The device of claim 2 wherein the pump fluid intake comprises one or more pump inlet perforations in a previous sidewall of the vortex sub.

4. The device of claim 3, further comprising one or more recirculation outlets formed as perforations on the pervious sidewall of the vortex sub, downstream of the pump fluid intake, said recirculation outlets serving to deliver the recirculation stream of fluid from the conduit to the pump fluid intake.

5. The device of claim 4, wherein the recirculation outlet perforations are angled such that recirculation fluid exiting the perforations flows a vortex pattern up and around to the pump fluid intake.

6. The device of claim 5, wherein the vortex sub comprises an impervious base curved concavely upwards, such that recirculation fluid impinging on said impervious base is directed to flow upwardly and out of said recirculation outlet perforations.

7. The device of claim 6, wherein said rotor unit comprises a rotor and a blade connected to a downstream end of the rotor, wherein said conduit extends through the rotor and the blade to a conduit outlet at a downstream end of the blade.

8. The device of claim 7, wherein the blade is paddle-shaped to enhance agitation of fluid within the vortex sub.

9. The device of claim 8, wherein said conduit outlet is preferably located downstream of the pump fluid intake and upstream of the impervious base of the vortex sub.

10. The device of claim 7, wherein said rotor unit comprises a rotor coupling at an upstream end of the rotor, said rotor coupling comprising said one or more recirculation inlets and a screen surrounding said one or more recirculation inlets.

11. The device of claim 1, wherein the conduit is supported within the bore of the rotor within a length of tubing, wherein said tubing comprises an outside diameter sized to fit within an inside diameter of the bore to minimize radial movement of the tubing within the bore.

12. The device of claim 11, wherein said conduit is radially centralized within the tubing.

13. The device of claim 12, wherein the conduit is centralized within the tubing by presence of a filler material between an inside diameter of the tubing and an outside diameter of the conduit.

14. The device of claim 12, wherein said one or more recirculation inlets have a total cross sectional area equivalent to approximately double the cross sectional area of the conduit.

15. A method of washing particulate from a fluid intake of a pump, said method comprising the steps of:

a. introducing a recirculating stream of fluid to be pumped into a conduit extending through an axial bore in a rotor unit of the pump;

b. directing the recirculation stream of fluid through the conduit from a first end proximal one or more recirculation inlets to a second end proximal the pump fluid intake;

c. providing a flow restriction by a length of the conduit to build up pressure in the recirculation stream of fluid; and d. delivering the recirculation stream of fluid under pressure from the conduit and directing the recirculation stream of fluid at the fluid intake of the pump to thereby wash away particulate from the fluid intake of the pump.

16. The method of claim 15, wherein delivering the recirculation stream of fluid comprises creating a vortex flow of recirculation fluid around the pump fluid intake.

17. The method of claim 16, wherein the vortex is created by delivering fluid through one or more recirculation outlet perforations, said perforations being angled such that the recirculation stream of fluid exiting the perforations flows a vortex pattern up and around to the pump fluid intake.

18. The method of claim 17, further comprising the step of agitating fluid within the vortex sub by rotation of a blade connected to a downstream end of the rotor unit and extending into the vortex sub.

* * * * *